US010465632B2

(12) United States Patent
Eckert et al.

(10) Patent No.: US 10,465,632 B2
(45) Date of Patent: Nov. 5, 2019

(54) METHOD AND DEVICE FOR OPERATING A COMBUSTION ENGINE

(71) Applicant: Robert Bosch GmbH, Stuttgart (DE)

(72) Inventors: Andreas Eckert, Korntal-Muenchingen (DE); David Schuetz, Ditzingen-Hirschlanden (DE); Matthias Mansbart, Rutesheim (DE); Sven Haubold, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/791,656

(22) Filed: Oct. 24, 2017

(65) Prior Publication Data

US 2019/0120177 A1 Apr. 25, 2019

(51) Int. Cl.

| | |
|---|---|
| ***F02M 25/022*** | (2006.01) |
| ***F02M 25/03*** | (2006.01) |
| ***F02M 35/02*** | (2006.01) |
| ***F02D 35/02*** | (2006.01) |
| ***F02D 41/14*** | (2006.01) |
| *F02D 41/00* | (2006.01) |

(52) U.S. Cl.

CPC ..... *F02M 25/0227* (2013.01); *F02D 35/023* (2013.01); *F02D 35/027* (2013.01); *F02D 41/1498* (2013.01); *F02M 25/03* (2013.01); *F02D 35/021* (2013.01); *F02D 41/0025* (2013.01); *F02D 2041/1412* (2013.01)

(58) Field of Classification Search

CPC .. F02M 25/0227; F02M 25/03; F02M 25/025; F02D 35/023; F02D 35/027; F02D 41/1498

See application file for complete search history.

(56) References Cited

U.S. PATENT DOCUMENTS

2011/0144893 A1* 6/2011 Rollinger ..... F02D 35/027 701/111
2014/0102403 A1* 4/2014 Yoshihara ..... F02D 35/027 123/25 A

FOREIGN PATENT DOCUMENTS

| | | | |
|---|---|---|---|
| DE | 3928611 | A1 | 3/1991 |
| DE | 102006054081 | A1 | 6/2007 |
| DE | 102007050511 | A1 | 4/2009 |

* cited by examiner

*Primary Examiner* — Jacob M Amick
(74) *Attorney, Agent, or Firm* — Norton Rose Fulbright US LLP; Gerard Messina

(57) ABSTRACT

A method and a device for operating a combustion engine which features an injection of a cooling fluid into a combustion chamber of the combustion engine, in which a knocking risk is determined during a current combustion in the combustion chamber, and an injection of the cooling fluid into the combustion chamber takes place when the knocking risk exceeds a threshold value.

9 Claims, 1 Drawing Sheet

METHOD AND DEVICE FOR OPERATING A COMBUSTION ENGINE

FIELD

The present invention relates to a method and a device for operating a combustion engine that features an injection of a cooling fluid into the combustion chamber of the combustion engine.

BACKGROUND INFORMATION

A conventional method and a conventional device for the injection of a cooling fluid (water) into a combustion chamber of a combustion engine is described in German Patent No. DE 39 28 611.

SUMMARY

In contrast, the method according to the present invention and the device according to the present invention for operating a combustion engine feature an injection of a cooling fluid into a combustion chamber of the combustion engine have the advantage that a direct knocking risk of a current combustion is determined and that an injection into this currently ongoing combustion is still able to prevent knocking or at least mitigate its harmful effects on the engine. This achieves a reduction in the knocking while the current combustion is still ongoing. More specifically, this measure makes it possible to prevent the occurrence of knocking in general. Knocking combustions are therefore avoidable before they even occur or are still able to be stopped or reduced during their development stage. Stressing of the engine by combustion knocks is reduced in this way, which allows for a long-term operation closer to the knocking limit due to the prevention of the otherwise unavoidable, recurrent knocking events. The combustion engines that are operated according to the method of the present invention are therefore able to be operated closer to the knocking limit and thus more effectively. In comparison with a conventional water injection, a considerably reduced consumption of cooling fluid is able to be achieved, thereby, for example, reducing the necessity for a replenishment in the case of a motor vehicle that is equipped with a combustion engine of this type.

Additional advantages and improvements are described herein. The detection of a knocking risk in the current combustion is accomplished in a particularly reliable manner by an evaluation of the pressure in the combustion chamber, said pressure being able to be measured directly in an especially precise manner with the aid of a combustion-chamber pressure sensor. Alternative measuring methods employ a structure-borne noise sensor or an ion-current sensor, which are much more cost-effective in comparison with a combustion-chamber pressure sensor. To assess a knocking risk, the pressure in the combustion chamber is compared to an expected value. The expected value not only considers the pressure but also the instant at which the pressure occurs following the onset of combustion, and also an angle position of the combustion engine. In addition to the absolute amount of the pressure, the instant or the angle position at which a particular pressure occurs in the combustion chamber is of importance when ascertaining whether or not a knocking risk exists. This makes it possible to detect a knocking risk in a particularly reliable manner. The expected values used for this purpose may be fixedly predefined in advance for a combustion engine, for instance in a stipulation for a particular type of engine. In addition, it is possible to evaluate combustion processes during the ongoing operation of the combustion engine on a continuous basis and to thereby learn typical expected values for the current combustion. If a considerable deviation then occurs between the current combustion and previous combustions, this would be a clear sign of an increased knocking risk. If an increased knocking risk is determined as a result of this evaluation, then it may be provided that an injection of cooling fluid also takes place for a predefined number of subsequent combustions. It is assumed simply that a determined knocking risk in one combustion indicates a generally higher knocking tendency of the combustion engine, meaning an injection of cooling fluid should then take place for a specified number of subsequent combustions. As an alternative, the activation of a coolant-fluid injection may be provided in the case of a detected knocking risk, with such an injection being maintained until a predefined change in the operating conditions of the combustion engine comes about. The change in the operating conditions may be defined by changes in the rotational speed, the engine load, or other operating parameters, for instance.

DETAILED DESCRIPTION OF EXAMPLE EMBODIMENTS

Figure 1:
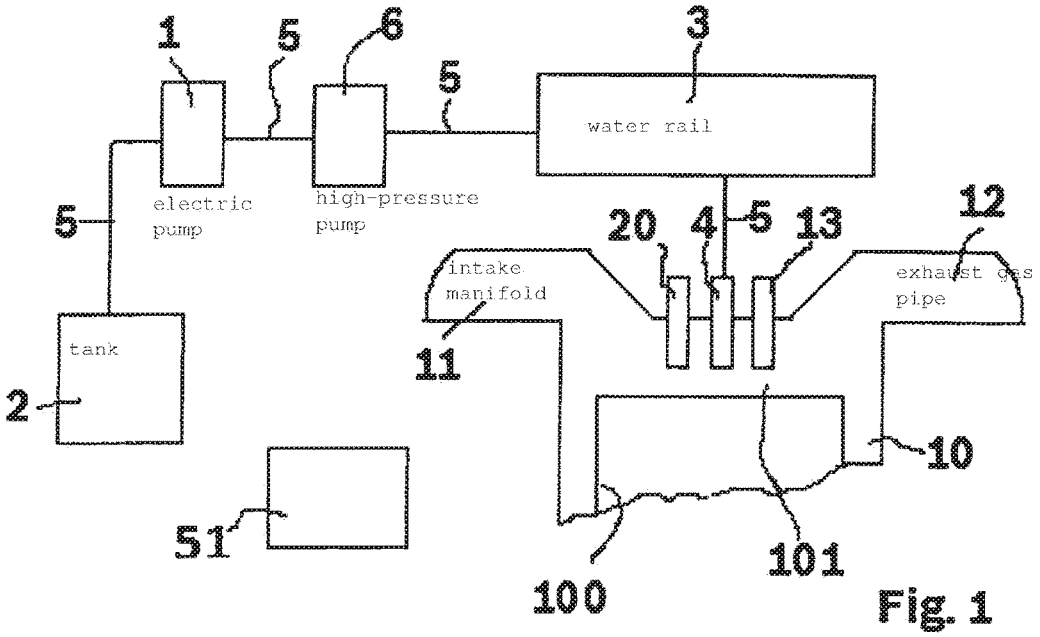
FIG. 1 shows schematically a combustion engine.

FIG. 1 schematically shows an engine, i.e. a combustion engine, which includes a cylinder 10. A combustion chamber 101 is defined by a piston 100 in cylinder 10. Air for a combustion is supplied to cylinder 10 or combustion chamber 101 through an intake manifold 11, and fuel for a combustion in cylinder 10 is supplied by a fuel injector 13. The exhaust gases produced in the process are carried away from cylinder 10 by way of exhaust-gas pipe 12. This involves a conventional gasoline engine or a Diesel engine, which is shown only schematically in FIG. 1. Not depicted, in particular, are further control elements such as air inlet and exhaust-gas discharge valves, means for influencing the air flow through intake manifold 11 (such as a throttle valve, for example), a spark plug, or a glow plug or other elements of conventional gasoline engines and Diesel engines, the reason being that they are unimportant for an understanding of the present invention.

In addition, an injection of a cooling fluid, in particular a water injection, into combustion chamber 101 is shown in FIG. 1. Below, while a water injection is described, it is also representative of the injection of any other cooling fluid. In addition to water, in particular a mixture of water and alcohol or a mixture of water with other fluids is possible. It is essential that the cooling fluid require a large quantity of heat when evaporating and thereby contributes to the cooling of the combustion chamber. An injection of water directly into the combustion chamber of cylinder 10 requires a considerable pressure. Since the injection into the combustion chamber of cylinder 10 is able to take place when the air-intake valve is already closed in the direction of intake manifold 11 and the cylinder is in a compression phase, the injection of water into a combustion chamber requires a considerably higher pressure up to an order of magnitude of 200 bar. As a result, water under high pressure is stored in water rail 3 in order to allow for an injection directly into the combustion chamber of cylinder 10. The water-injection system is made up of a water tank 2, which is connected to an electric pump 1 by a connection line 5. Via connection line 5, water is able to flow from tank 2 to electric pump 1, or be aspirated from the tank by electric pump 1. The side of electric pump 1 that is connected to water tank 2 via connection line 5 is called an intake in the following text. In addition, electric pump 1 has a high-pressure outlet, which is connected to a high-pressure pump 6 by way of a connection line 5. The intake of high-pressure pump 6 is connected via a connection line 5 to the high-pressure outlet of electric pump 1, and the high-pressure outlet of high-pressure pump 6 is connected to water rail 3 by way of a connection line 5.

Via another connection line 5, water rail 3 is then connected to a water injector 4, which terminates in combustion chamber 101. The water in tank 2 is thus supplied via the intake of electric pump 1 and made available at increased pressure at the high-pressure output of pump 1 to a high-pressure pump 6. This water, brought to a high pressure of approximately 200 bar by high-pressure pump 6, is then temporarily stored in water rail 3, until it is injected through a corresponding opening of water injector 4 into combustion chamber 101. This creates a system in which a sufficiently high pressure is generated to allow for an injection of water directly into the combustion chamber of the engine.

It is also possible to connect to water rail 3 a multitude of water injectors 4, which supply water to a plurality of cylinders 10. This is a development in particular in multi-cylinder engines that are common these days in motor vehicles, by which each cylinder is able to be individually supplied with a quantity of water that is specifically adapted to said cylinder.

The injection of water in conjunction with the fuel injected through fuel injector 13 creates a mixture of air, fuel and water inside combustion chamber 101 of cylinder 10. With the aid of a corresponding ignition, either by a spark plug or by an auto-ignition process in the case of a Diesel engine, a combustion of the fuel-air mixture then takes place inside the combustion chamber of cylinder 10. Because of the water contained in this air-fuel mixture, effective cooling of combustion chamber 101 in cylinder 10 is carried out, thereby lowering the combustion temperature and reducing the knocking tendency in the application in the gasoline engine. This enables an optimal moment of ignition, which has a positive effect on the efficiency or consumption of the gasoline engine. In the case of a gasoline or Diesel engine, the creation of harmful exhaust gases is additionally able to be reduced. The introduction of water into a combustion chamber therefore constitutes a measure by which the quality of the combustion in the combustion chamber of a cylinder 10 is able to be influenced in a positive manner. Both the quality of the exhaust gas and the thermal loading of cylinder 10, as well as the performance and also the fuel requirement are able to be positively affected by such a measure.

FIG. 1 additionally shows a combustion-chamber pressure sensor 20, which projects into combustion chamber 101 and measures the pressure in the combustion chamber instantly and directly. Because of such a pressure sensor, the pressure conditions in combustion chamber 101 are, thus, known at all times; in particular, such a direct pressure measurement of the combustion chamber allows for direct monitoring of an ongoing combustion and of the pressures that arise in the process. More specifically, such a direct pressure measurement makes it possible to already detect in the first half of the combustion whether knocking will occur in the further course of combustion process. Such knocking combustions refer to combustions in which an ignition spark not only induces the actual ignition, but in which a spontaneous ignition of the gas-air mixture also takes place at several other locations in the combustion chamber, and the multiple flame fronts that originate from the different production locations come to meet. Very high pressures and pressure gradients come about in such combustion knocks, which may cause damage to the combustion engine, in particular damage to piston 100. On the other hand, an operation of a combustion engine in the vicinity of a knocking operating point is particularly effective since the energy produced there through the combustion is especially effectively converted into mechanical movement. Therefore, it is desirable to operate a combustion engine in the closest possible proximity to a knocking operation without knocking actually taking place in the process. According to the present invention, it is now proposed to assess, through an evaluation of the current combustion that is developing, whether knocking will arise in the further course of the combustion and, if so, to still induce, by an injection of water directly into the current combustion, cooling of the current combustion and thereby still prevent the knocking during the ongoing current combustion. As a result, this measure allows for an operation of the combustion engine very close to the knocking limit without knocking ever occurring.

As an alternative to a combustion-chamber pressure sensor 20, the use of other sensors that allow for an evaluation of an ongoing combustion is also possible. A knock sensor is mounted on the outside of cylinder 10 and measures the combustion noise, which is likewise a measure for the pressure occurring in combustion chamber 101. Such a knock sensor is a structure-borne noise sensor or a vibration sensor, which is typically developed as a piezoelectric sensor or an acceleration sensor. Another possibility consists of using an ion-current sensor, in which a voltage is applied between electrodes in the combustion chamber, and a current flow between these two electrodes through the gas mixture in the combustion chamber is evaluated. The conductivity depends very strongly on the pressure in the combustion chamber, so that these sensors also supply information about the pressure conditions in the combustion chamber. However, because of the direct evaluability, the use of a combustion-chamber pressure sensor is preferred.

It has become evident that an evaluation of the pressure characteristic of the first half of a combustion allows for a relatively reliable assessment as to whether or not knocking will occur in the second half of the combustion. By injecting a cooling fluid, in particular water, it is then still possible to influence the temperature of the second half of the combustion in such a way that knocking will be suppressed or else the intensity of the knocking will be considerably reduced. In this way, a combustion engine is able to be operated close to the knocking limit without knocking necessarily having to repeatedly occur. For the assessment as to whether or not knocking will occur during the currently ongoing combustion, an evaluation of a knocking risk due to the pressure in the combustion chamber is carried out. To do so, the pressure is compared to an expected value, the expected value taking into account not only the level of the pressure but also the instant or the angle position of the pressure. The goal in a combustion in a combustion engine consists of having the pressure maximum occur after top-dead-center of piston 100 in cylinder 10. A knocking risk is detected when increased pressure values arise prematurely, i.e. at a very advanced angle position. These expected values, i.e., the combination of pressure value and angle position or the instant following an onset of the combustion, may be fixedly predefined or may be learned during the ongoing operation of the combustion engine. If the values are fixedly predefined, then it is stipulated during a design phase or an application phase for a particular type of combustion engine what kind of expected values must be exceeded in order to identify a knocking risk for the further course of the combustion. This stipulation may depend on operating conditions of the combustion engine such as the load or rotational speed. As an alternative, however, it is also possible to learn these expected values. In the process, typical pressure characteristics during the ongoing operation of the internal combustion engine would be stored, e.g., by averaging. If a pressure characteristic then considerably deviates from this learned typical pressure characteristic during a combustion and, in particular, exceeds it, then a knocking risk will be detected on that basis and the injection according to the present invention will be triggered in the further course of the combustion. Such learning may also depend on operating parameters of the internal combustion engine such as the load or the rotational speed.

Once a knocking risk has been identified during a current combustion, then it must also be specified whether the injection of coolant fluid will take place only for this one particular combustion or whether subsequent combustions should also be carried out with an injection of the cooling fluid. The reason for this is that the one-time occurrence of a knocking risk is an indication that the internal combustion engine is in an operating state just then in which it tends to knock, which is why measures should be taken to prevent further knocking events as well. Of course, since an injection of cooling fluid already at the start of a combustion is a more suitable measure for reducing an occurrence of knocking, it is advantageous to carry out additional cooling as a preventive measure by injecting a cooling fluid once a knocking risk has been detected. One option consists of simply carrying out an injection of the cooling fluid for a predefined number of subsequent combustions once a singular knocking risk has been identified. This is done regardless of whether a knocking risk is detected again. Since in this operation the injection of the cooling fluid already takes place at the start of the combustion, a knocking risk in the first half of the combustion would no longer be detectable anyway. A return to a method in which an injection of cooling fluid does not take place from the outset but only when a knocking risk is determined in a current combustion, is implemented only after an injection of cooling fluid has occurred for a predefined number of combustions. As an alternative, when a knocking risk is detected, the general activation of a cooling-fluid injection for all subsequent combustions may be provided after the injection into the currently ongoing knock-endangered combustion has occurred. This injection of cooling fluid would then continue until a marked change in the operating conditions of the combustion engine has come about. In this context, it may particularly be provided that a deactivation of the injection of cooling fluid is provided only if the operating conditions of the internal combustion engine change in the direction of a reduced knocking tendency, e.g., by an obvious reduction in the loading or in the rotational speed.

Figure 2:
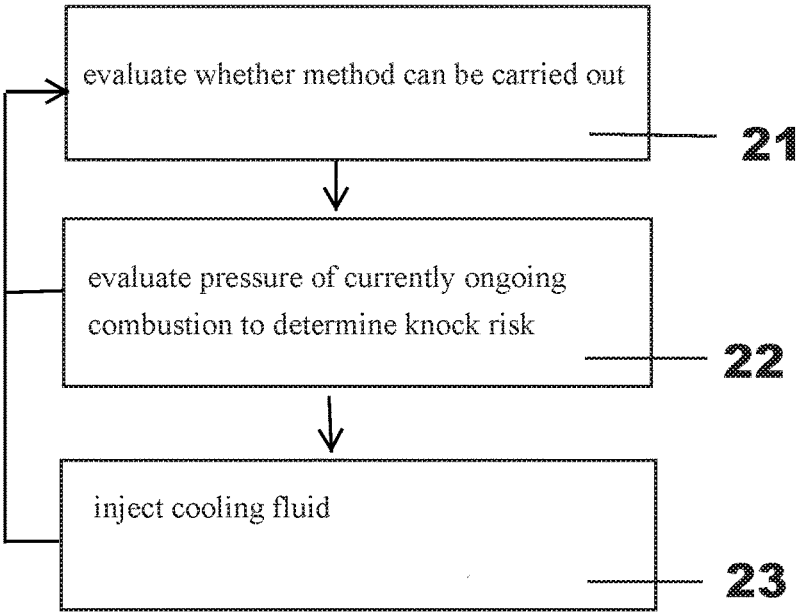
FIG. 2 shows steps of an example method in accordance with the present invention.

FIG. 2 schematically illustrates the individual steps of the method according to the present invention. In a first step 21, it is verified whether the method according to the present invention is able to be carried out at all. A pertinent prerequisite would be that cooling fluid is actually available for the injection or that no error report exists for combustion-chamber pressure sensor 20 or that a warm-up operation of the combustion engine has been concluded or that other preconditions are satisfied. In the following step 22, an evaluation of the pressure of the currently ongoing combustion takes place for the purpose of determining a knocking risk. To do so, the pressure is especially compared to a threshold value or to a sequence of threshold values, the threshold values not only taking into account the magnitude of the pressure but also the temporal occurrence of the pressure. For instance, this temporal occurrence can be defined as the instant following the onset of the combustion or the instant before top-dead-center of the piston, or else it may be defined as an angle value of the combustion engine. In the event that the knocking risk exceeds a threshold value, an injection of cooling fluid into the currently ongoing combustion will be triggered. Typically, combustion knocks occur in the second half of a combustion. Thus, a knocking risk is usually detected in the first half of a developing combustion in order to then carry out an injection of cooling fluid in the second half of a combustion. If no knocking risk is detected in step 22, step 22 will be followed by step 21 again. If a knocking risk is detected in step 22, then step 22 will be followed by step 23, in which an injection of cooling fluid into the currently ongoing combustion is carried out. This measure suppresses the occurrence of knocks or at least reduces the knocking intensity. Step 23 will then be followed by step 21 again.

What is claimed is:

1. A method for operating a combustion engine, comprising:

determining a knocking risk during a current combustion in a combustion chamber of the combustion engine;

if the knocking risk exceed a threshold value, injecting cooling fluid into the combustion chamber in the current combustion, wherein a pressure in the combustion chamber is evaluated for assessing the knocking risk, and wherein the pressure is evaluated in a first half of the current combustion to determine if a knocking will occur in a second half of the current combustion.

2. The method as recited in claim 1, wherein the pressure in the combustion chamber is one of: (i) directly measured by a combustion-chamber pressure sensor, or (ii) indirectly measured by a structure-borne noise sensor or an ion-current sensor.

3. The method as recited in claim 1, wherein as the threshold value, the pressure is compared to at least one expected value, the expected value corresponding to one of: (i) a pressure at a specific instant following an onset of the combustion, or (ii) an angle position of the combustion engine.

4. The method as recited in claim 3, wherein the expected value is one of: (i) fixedly predefined for the combustion engine, or (ii) learned during ongoing operation of the combustion engine.

5. The method as recited in claim 1, wherein if the knocking risk exceeds the threshold value in the current combustion, an injection of the cooling fluid takes place for a predefined number of subsequent combustions, regardless of whether or not the knocking risk exceeds the threshold value again.

6. The method as recited in claim 1, wherein when the knocking risk exceeds the threshold value in the current combustion, an injection of the cooling fluid takes place for subsequent combustions, regardless of whether or not the knocking risk exceeds the threshold value again, and the injection of the cooling fluid is stopped again only when a predefined change in operating conditions of the combustion engine comes about.

7. A device for operating a combustion engine, the device comprising:

means for determining a knocking risk during a current combustion in a combustion chamber of the combustion engine, and for inducing an injection of cooling fluid into the combustion chamber when the knocking risk exceeds a threshold value, wherein the means for determining includes means for evaluating a pressure in the combustion chamber for assessing the knocking risk, and wherein the pressure is evaluated in a first half of the current combustion to determine if a knocking will occur in a second half of the current combustion.

8. The device as recited in claim 7, wherein the means is a control unit.

9. A method for operating a combustion engine, comprising:

determining a knocking risk during a currently ongoing combustion in a combustion chamber of the combustion engine; and if the knocking risk exceed a threshold value, injecting cooling fluid into the combustion chamber during the currently ongoing combustion in which the knocking risk has been determined, wherein a pressure in the combustion chamber is evaluated for assessing the knocking risk, and wherein the pressure is evaluated in a first half of the currently ongoing combustion to determine if a knocking will occur in a second half of the currently ongoing combustion.

* * * * *